United States Patent [19]

Johnson

[11] Patent Number: 4,903,772

[45] Date of Patent: Feb. 27, 1990

[54] METHOD OF FRACTURING A GEOLOGICAL FORMATION

[76] Inventor: James O. Johnson, 2679-B Walnut, Los Alamos, N. Mex. 87544

[21] Appl. No.: 121,131

[22] Filed: Nov. 16, 1987

[51] Int. Cl.[4] ..... E21B 43/17

[52] U.S. Cl. ..... 166/299; 166/308; 299/13

[58] Field of Search ..... 166/299, 308; 299/13

[56] References Cited

U.S. PATENT DOCUMENTS

| | | | |
|---|---|---|---|
| 2,676,662 | 4/1954 | Ritzmann . | |
| 2,988,143 | 6/1961 | Scotby | 166/299 |
| 3,313,234 | 4/1967 | Mohaupt . | |
| 3,964,792 | 6/1976 | Archibald | 299/13 |
| 4,018,293 | 4/1977 | Keller | 166/299 X |
| 4,049,056 | 9/1977 | Godfrey | 166/299 |
| 4,091,870 | 5/1978 | Godfrey et al. | 166/299 |
| 4,345,650 | 8/1982 | Wesley | 166/249 |
| 4,451,088 | 5/1984 | Wisseroth | 299/11 |

*Primary Examiner*—William P. Neuder
*Attorney, Agent, or Firm*—William A. Eklund

[57] ABSTRACT

An improved method of fracturing a geological formation surrounding a well bore is disclosed. A relatively small explosive charge is emplaced in a well bore and the bore is subsequently hydraulically pressurized to a pressure less than the formation breakdown pressure and preferably greater than the fracture propagation pressure of the formation. The charge is denoted while the bore is so pressurized, resulting in the formation of multiple fractures in the surrounding formation with little or no accompanying formation damage. Subsequent hydraulic pressurization can be used to propagate and extend the fractures in a conventional manner. The method is useful for stimulating production of oil, gas and possibly water from suitable geologic formations.

14 Claims, 4 Drawing Sheets

METHOD OF FRACTURING A GEOLOGICAL FORMATION

The U.S. Government has rights in this invention pursuant to Contract No. W-7405-ENG-36 awarded by the U.S. Department of Energy.

BACKGROUND OF THE INVENTION

1. Field of the Invention.

The invention described and claimed herein is generally related to methods for fracturing geological formations surrounding well bores, generally for the purpose of stimulating the production of oil or gas.

2. Description of the Related Art.

Various methods have been employed to fracture oil- or gas-bearing geological formations in the vicinity of well bores, for the purpose of stimulating the flow of oil or gas into the well bore. These methods largely fall into two categories; explosive fracturing and hydraulic fracturing.

Explosive fracturing consists simply of detonating a high explosive in a well bore, thereby fracturing the surrounding geological formation. Explosive fracturing was widely used in the oil and gas industry until about 1950, primarily in uncased wells, but has been used only sparsely since that time. It was recognized in the art that conventional explosive fracturing requires large amounts of explosives and, more importantly, results in so much compaction or other damage to the well bore and the surrounding formation as to commonly require extensive clean-up operations after the shot. As a consequence of this relative inefficiency of explosive fracturing, and also as a consequence of the safety hazards associated with handling large amounts of explosives, explosive fracturing has been essentially abandoned and supplanted by hydraulic fracturing.

In conventional hydraulic fracturing, a well bore is filled with a fracturing fluid and is hydraulically pressurized until the formation is fractured, or until "formation breakdown" is obtained. Hydraulic fracturing is typically performed in cased wells. The metal casing is first cemented in, after which both the casing and the surrounding cement are perforated with special explosive perforation charges. The fracturing fluid is then injected under pressure through the perforations and into the formation until the formation fractures, without causing any damage to the casing. Hydraulic fracturing is typically augmented by the use of proppants and other well known oil recovery stimulation methods.

Although hydraulic fracturing has been widely used, it nevertheless suffers from several problems. One problem is that very high pressures may be required, particularly in deep wells. Occasionally the pressure required to fracture deep formations is so high as to be beyond the capacity of commercially available hydraulic fracturing equipment.

Perhaps the most significant problem, however, is that hydraulic fracturing typically produces only a single fracture, or at most a very small number of fractures. This occurs because it requires considerably less pressure to enlarge an existing fracture than to create a new one. Consequently, once a first fracture has been created, further pumping simply results in the first fracture being further propagated. Additional injecting of fracturing fluid simply results in the fluid being injected into the first fracture, with no additional fractures being created. It is typically impossible to create additional fractures once the formation has been initially fractured, and thus the stimulation of oil or gas flow is limited to that which can be obtained by the creation of a single fracture.

Furthermore, the location at which fracturing occurs is determined by the weakest point in the formation. It is commonly found that one or more oil- or gas-bearing formations occur only at particular depth ranges within a well, and hence it is desired to hydraulically fracture only those formations. Because of the difficulty noted above in forming more than one fracture, packers, high pressure tubing and other special equipment are used to localize the region of the well bore that is pressurized and fractured. Although these devices permit some control over the depth range at which a fracture is formed, they are costly and time consuming to install and utilize effectively.

Another limitation of hydraulic fracturing is that there is no way to control the direction of fracturing. In some cases it is desirable to be able to selectively fracture a formation in a particular direction away from a well bore. The packers and other equipment mentioned above provide some control over the depth at which fracturing occurs, but provide no control over the direction of fracturing away from the well bore.

U.S. Pat. No. 2,676,662 to Ritzmann discloses a method for enhancing oil recovery in a well. In accordance with the method of Ritzmann, a formation is first hydraulically fractured and then subjected to an explosive detonation to created irregularities in the hyraulically-formed fractures and thereby prop the fractures open. The method of Ritzmann differs from the method of the present invention in that, as will be discussed below, in the method of the present invention the formation is not hydraulically fractured prior to detonation.

Accordingly, it is the object and purpose of the present invention to provide an improved method of fracturing a geological formation surrounding a well bore.

More particularly, it is an object and purpose of the present invention to provide a method of forming a large number of radially extending fractures in a geological formation surrounding a well bore, without in the process significantly damaging the well casing or compacting the adjacent geological formation.

It is another object and purpose of the present invention to provide a method of fracturing a geological formation, in which both the depth and the direction of fracturing can be easily controlled.

SUMMARY OF THE INVENTION

The present invention provides a method of fracturing a geological formation in the vicinity of a well bore. The method comprises the steps of emplacing a relatively small explosive charge in the well bore, preferably at the depth of a known fluid-bearing formation, followed by the step of hyraulically pressurizing the well to a pressure less than the formation breakdown pressure, and preferably greater than the fracture propagation pressure of the formation, and followed by the step of detonating the explosive charge while the well is so pressurized. The size of the explosive charge is selected so that it is sufficiently small that it will not cause significant damage to either the well casing or the surrounding formation. The combination of hydraulic pressure with a small explosive detonation results in the simultaneous formation of numerous shock induced, hydraulically driven fractures, which may be further extended into the formation by subsequent injection of fracturing fluid. Experimental studies have found that this method results in the formation of numerous radially extending fractures in the geological formation, without crushing, compacting or otherwise damaging either the surrounding geological formation or the well casing.

The shock induced, hydraulically driven fractures are formed primarily in the vicinity of the explosive charge, even though the entire well bore may be pressurized. Consequently it is possible to localize the region where the fracturing takes place simply by selecting the placement of the explosive charge, while avoiding altogether the use of packers and other special equipment normally used for this purpose.

The method of the present invention may be advantageously employed with reflectors and attenuators which focus the shock waves from the explosive charge, thereby permitting selective fracturing in a particular direction away from a well bore. Because the explosive charge is relatively small, the use of reflectors is particularly useful because they are not destroyed by the explosive charge and thus operate effectively to direct shock waves from the explosive charge in a particularly direction.

These and other aspects of the invention are described in more detail in the following detailed description of the preferred embodiment.

BRIEF DESCRIPTION OF THE DRAWINGS

The accompanying drawings are incorporated in and form a part of this specification, and when taken with the following detailed description of the invention serve to illustrate the principles and operation of the method of the invention.

In the drawings.

DESCRIPTION OF THE PREFERRED EMBODIMENT

Figure 1:
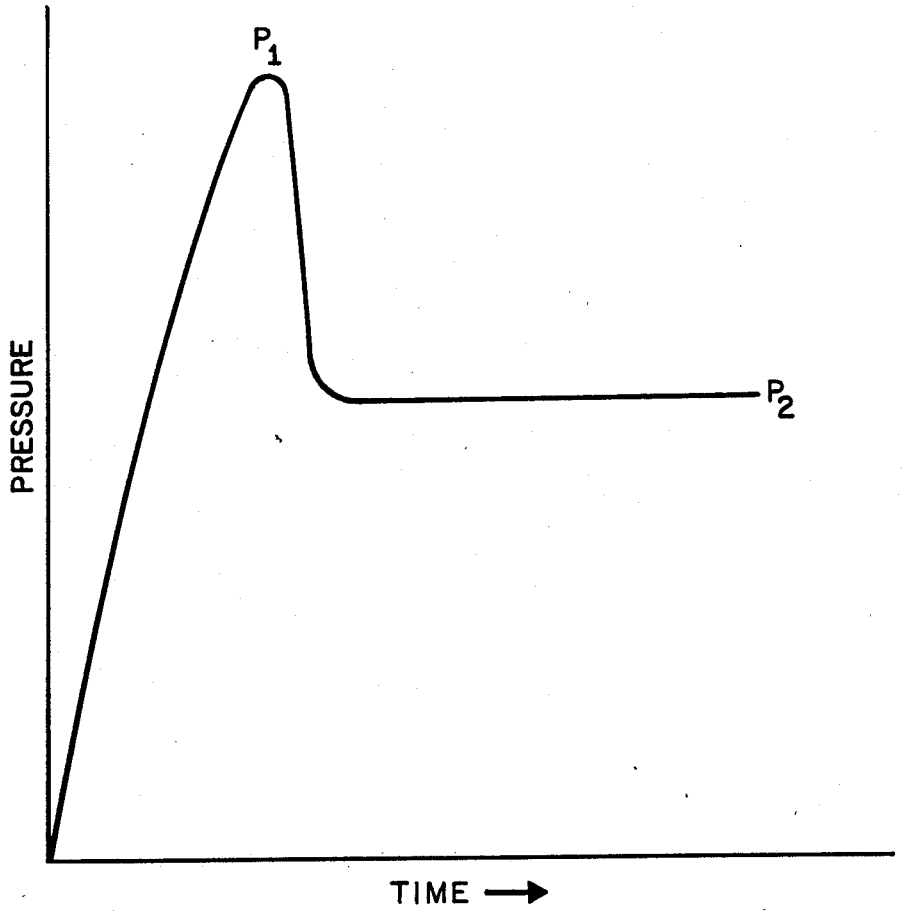
FIG. 1 is a plot of pressure versus time for a typical conventional hydraulic fracturing operation.

FIG. 1 is a plot illustrating the progress of a typical conventional hydraulic fracturing operation conducting without the method of the present invention, and is presented as background to the following description of the present invention.

When a fracturing fluid is injected into a well bore at a substantially constant rate, the pressure increases rapidly (indicated by the steep portion of the curve in FIG. 1) until formation breakdown occurs at pressure $P_1$. The formation breakdown pressure is the maximum pressure attained in the well, and is the pressure at which the first fracture is formed. Following the formation breakdown, subsequent hydraulic fluid may be introduced into the well bore at a somewhat lower fracture propagation pressure, $P_2$. This latter pressure $P_2$ remains substantially constant with further injection of fluid.

It is generally believed that the formation breakdown pressure $P_1$ represents the pressure required to initiate a fracture in the geological formation surrounding the well bore. This pressure is related to the strength of the rock or other material of which the geological formation is composed. The subsequent fracture propagation pressure $P_2$ represents the pressure required to extend one or more fractures once they have been initiated. The fracture propagation pressure $P_2$ generally increases with the overburden pressure of the formation; that is, it increases with the depth of the fracture zone.

In the method of the present invention, a relatively small explosive charge is emplaced in the well bore at a depth where fracturing is desired. The well bore is subsequently pressurized to a pressure that is less than the formation breakdown pressure $P_1$, and preferably also greater than the fracture propagation pressure $P_2$. In doing this it is necessary to estimate in advance how highly the well may be pressurized without surpassing pressure $P_1$ and thereby prematurely fracturing the formation by hydraulic pressure alone. A determination of how highly the well may be pressurized without hydraulically fracturing the well may be made in several ways. First, knowledge of the formation breakdown pressure measured in the same or similar geological formations in nearby wells may be used to estimate the formation breakdown pressure in a new well, so that that pressure can be used as an upper limit to pressurization in the present method. Also, knowledge of the nature of the formation material may be used to estimate the upper pressurization limit.

The charge is detonated while the well bore is pressurized as described above. The use of a sufficiently small charge results in only minimal damage to the well casing and the surrounding geological formation, yet also results in production of multiple fractures in the formation in the vicinity of the explosive charge. The resulting shock induced hydraulically driven fractures extend generally radially away from the well. The use of a small charge results in little or no compaction, rubblizing, crushing or other formation damage, and does not rupture the well casing.

The multiple fractures formed by the method of the invention are generally concentrated in the vicinity of the explosive charge. Accordingly, if the location of one or more oil- or gas-bearing formations is known from well logging, the small explosive charges are preferably placed at depths corresponding to such locations. This may result in selective fracturing primarily in the vicinity of the oil or gas bearing formations, leaving the remainder of the well bore otherwise undamaged and unfractured.

Various explosives may be used to practice the invention. Examples are trinitrotoluene (TNT), cyclotetramethylene-tetranitramine (HMX), cyclotrimethylene-trinitramine (RDX), pentaerythritol tetranitrate (PETN), hexanitrostilbene (HNS) and picrylamino dinitropyridine (PYX). Typical explosive loading densities may preferably be in the range of from one to four grams per centimeter of well bore length.

Following detonation of the explosive charge, the resulting fractures may be extended by subsequent hydraulic injection of fracturing fluid in a conventional manner. Proppants, acid solutions and other conventional production-stimulating means may be employed as desired.

Figure 2:
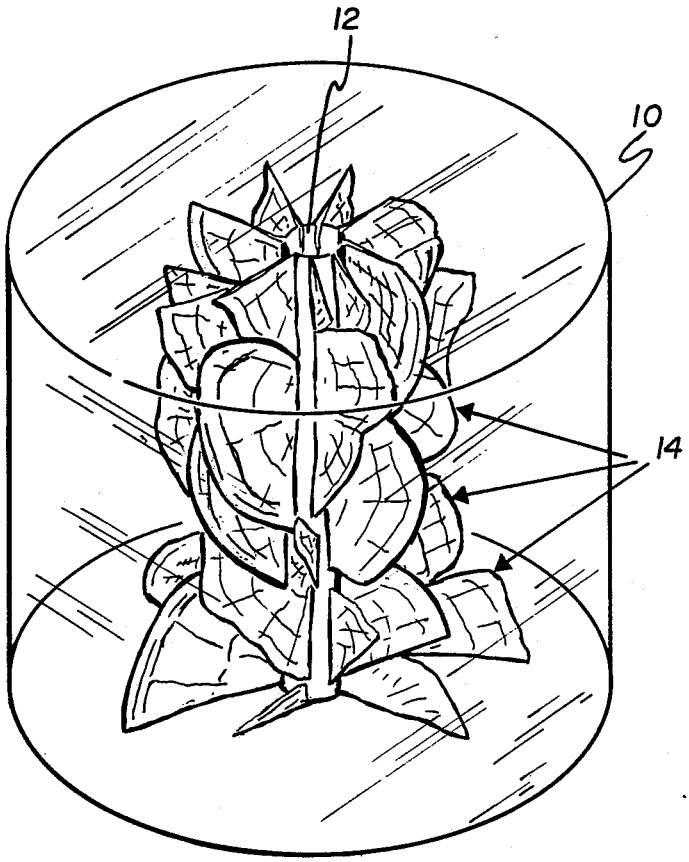
FIG. 2 is an illustration of the fracture results achieved with the method of the invention, as applied to a model formation.

FIG. 2 is an illustration of the results of a small-scale demonstration of the method of the present invention.

In this demonstration the method was applied to a solid cylindrical block 10 of clear polymethylmethacrylate (PMMA) plastic. The block was 7 inches in diameter and 4¼ inches in length. A bore 12 approximately ½ inch in diameter was formed along the cylindrical axis of the block, extending partially through the block. A mild detonating fuse containing approximately 0.080 gram of explosive (not shown) was emplaced approximately in the center of the bore 12. The bore 12 was then fitted with a suitable pipe fitting to allow sealing and pressurization of the bore 12 with oil to a pressure of approximately 2,000 pounds per square inch.

While the bore 12 was so pressurized, the explosive fuse was detonated. Upon detonation for the explosive fuse there were formed approximately fifty (50) axially extending, vertically oriented fracture 14, along with circumferential fractures at each end of the bore. The formation of the multiple fractures 14 in this manner is a consequence of pressurizing the block to a pressure near its yield strength prior to detonation. Hydraulic fracturing of similar blocks without use of the small amount of explosive typically results in the formation of a only single fracture.

Figure 3:
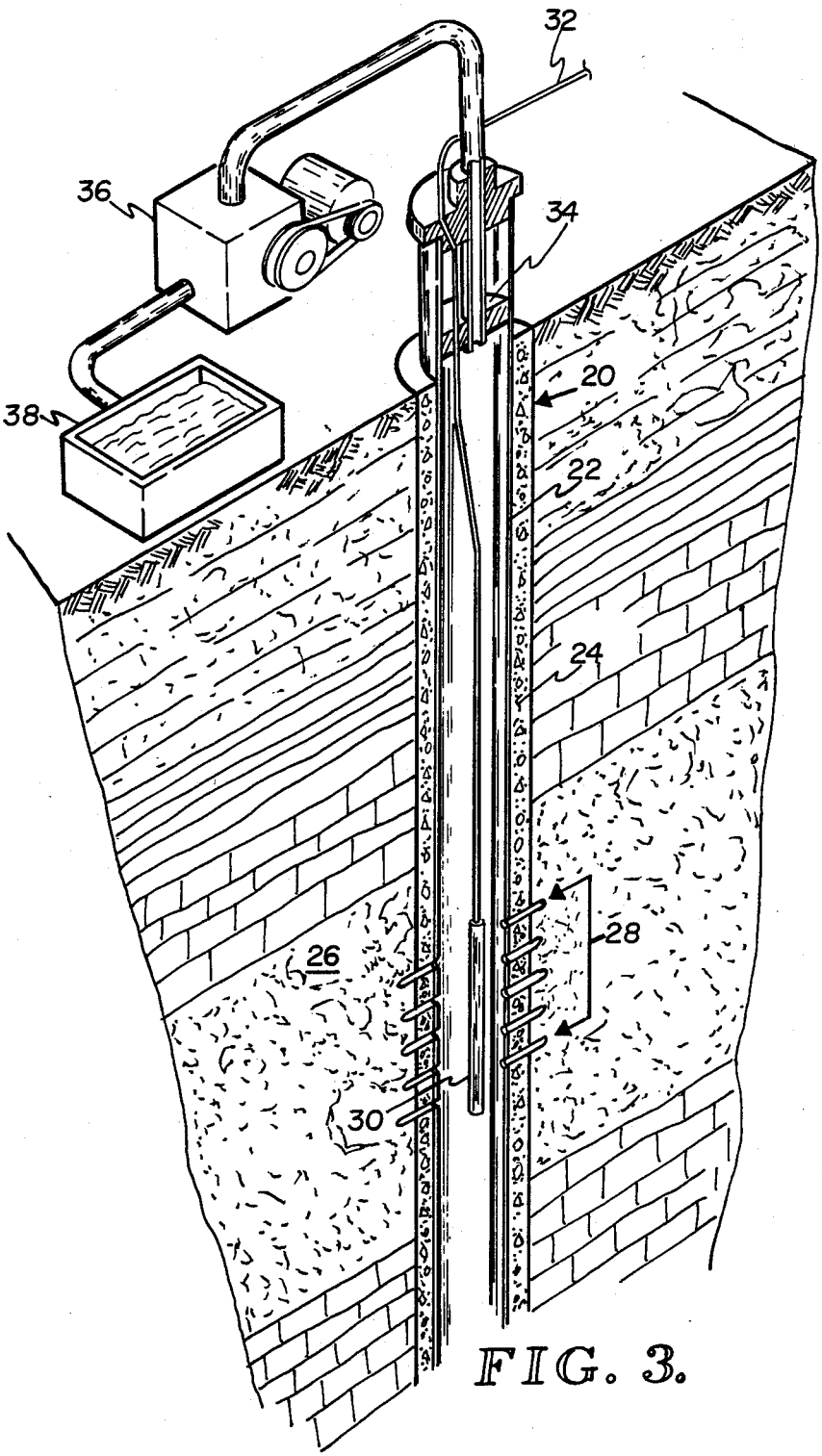
FIG. 3 illustrates how the method of the present invention is used in a well bore to fracture an oil- or gas-bearing geological formation.

The practice of the present invention in an actual well bore is illustrated in FIG. 3. In FIG. 3 there is illustrated a well bore 20 which includes a steel casing 22 and cement 24 surrounding the casing. An oil- or gas-bearing geological formation 26 is illustrated as extending over a limited depth range of the well bore 20. Perforations 28 are formed in the casing 22 and the cement 24 over the depth range of the oil- or gas-bearing formation 26, so as to allow fracturing fluid to be pumped through the casing 22 and cement 24, and thereby pressurize the formation 26 without damaging the casing 22 or cement 24.

An explosive charge 30 is emplaced in the well bore 20, generally centered within the depth range of the oil- or gas-bearing formation 26. As illustrated, the explosive charge 30 is relatively small, and occupies only a small portion of the volume of the well casing 22 over the length of the charge 30. A preferred loading of the explosive charge 30 is believed to be approximately one to six grams per centimeter of well depth, although other loadings may also provide satisfactory. The loading of the explosive charge 30 should be sufficiently small so that it will not cause damage to either the well casing 22 or the formation 26 upon detonation. It is noted that a loading of one to six grams per centimeter is only a small fraction, on the order of one percent, of the amount of explosive that can be loaded into conventional well casing having inside diameters of approximately five to ten inches.

The explosive charge 30 may be suitably encased in a container, as may be required, and is suspended by a detonating wire 32, which passes through a suitable packer 34 at the well head. The packer 34 operates to seal the well head so as to allow the well to be hydraulically pressurized by means of a suitable hydraulic pump 36 and a fracturing fluid contained in a fracturing fluid reservoir 38.

Figure 4:
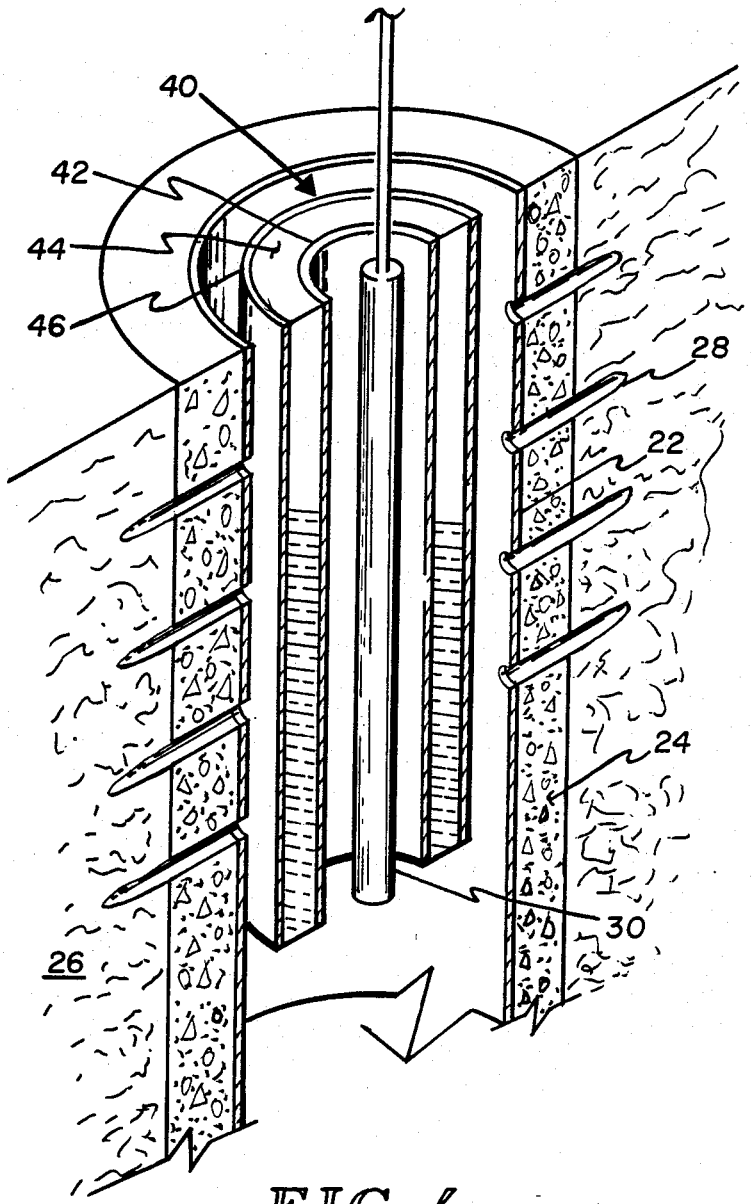
FIG. 4 illustrates how a reflector-attenuator may be used in the method of the present invention to focus shock waves in a particular direction.

Referring to FIG. 4, a well bore 20 is illustrated as being provided with a compound reflector-attenuator apparatus 40 which operates to selectively reflect shock waves from the explosive charge 30 in one direction. The reflector-attenuator apparatus 40 is a hemitubular apparatus having an inner reflector element 42 made of a high shock-impedance material such as brass or steel; an attenuator 44 which may consist simply of the fracturing fluid itself or may be formed of a low shock-impedance material such as wood or a polymeric foam; and an outer reflector element 46 made of a high shock-impedance material such as brass or steel. The combination of high- and low-impedance materials results in optimum performance of the reflector-attenuator apparatus 40 for the purpose of directing shock waves from the explosive charge 30.

In the implementation of the method, the pump 36 is first operated to pressurize the formation 26 to a pressure less than the formation breakdown pressure of formation 26, but preferably greater than the fracture propagation pressure of the formation 26. While the formation 26 is so pressurized, the explosive charge 30 is detonated, producing multiple fractures in the formation 26. Such fractures will be uniformly distributed around the well bore 20; or they may be concentrated on one side of the well bore if a reflector is utilized.

It will be recognized that the well casing 22 is not damaged by the detonation of the charge 30. Although the casing 22 and cements 24 are provided with perforations 28 to allow passage of the fracturing fluid, such perforations are not necessary for the passage of shock waves from the explosive charge 30 through the casing 22 and cement 24. Shock waves from the charge 30 pass directly through the casing 22. The cement 24 may be fractured along with the formation 26; however this only serves to increase the permeability of the cement 24 as well as that of the formation. Because the charge 30 is small, the shock waves therefrom do not damage the casing 22 in any significant way. Furthermore, the perforations 28 are not normally obstructed by the detonation of the charge 30. As a result, multiple fractures are formed in the formation 26, without the casing 22 or cement 24 being damaged or the perforations 28 being obstructed, and without the formation 26 being compacted by the effects of the explosive charge 30.

It is believed that the present invention will be useful in the stimulation of oil and gas, and possibly also water, from appropriate geological formations. The present information may also be useful in quarrying operations. The primary advantage of the present invention over previously known methods of explosive or hydraulic fracturing is that with the present invention a large number of radially extending fractures can be formed in a geological formation, without accompanying compaction of or other damage to the adjacent formation.

The method of the present invention also lends itself particularly well to directional fracturing, by the use of reflectors as may be known in the prior art or as described and illustrated herein. Reflectors consist in their simplest form of hemicylindrical or hemitubular shells, such as the reflector-attenuator apparatus 40 shown in FIGS. 4, which are inserted alongside the explosive charge emplaced in a well bore. The reflector causes the shock waves from the charge to be emitted from the well bore primarily in one direction, away from the reflector, so as to selectively fracture the formation on one side of the well. The present invention is particularly well suited to the use of reflectors, because the reflectors are not destroyed by the small charges used in the method of present invention, thereby making them more efficient in reflecting the shock waves in a controlled manner.

Although the present invention is described herein by reference to the above described preferred embodiment of the invention, it will be understood that various modifications, variations and alterations may be adopted without departing from the essential invention. According, the scope of the present invention is defined by the following claims.

What is claimed is:

1. A method of fracturing a geological formation surrounding a cased well bore, comprising the steps of:

(a) emplacing at least one explosive charge in a well bore provided with a casing in the vicinity of said explosive charge, said charge being no larger than that necessary to initiate formation breakdown in said formation when said formation is pressurized to a pressure less than the formation breakdown pressure of said formation;

(b) emplacing a suitable fluid in said well bore and hydraulically pressurizing said fluid to a pressure less than the formation breakdown pressure and greater than the fracture propagation pressure of said geological formation; and (c) detonating said explosive charge while said fluid is pressurized, so as to obtain a multiplicity of fractures in said geological formation.

2. The method defined claim 1 wherein the loading density of said explosive charge is between approximately one and six grams per centimeter of well bore length.

3. The method defined in claim 1 further comprising the step of hydraulically pressurizing said well bore after detonation of said explosive charge so as to extend and propagate fractures formed by said detonation.

4. The method defined in claim 1 wherein said explosive charge is emplaced at locations in said well bore corresponding to the depths of oil- or gas-bearing formations.

5. The method defined in claim 1 wherein said explosive charge is selected from the group consisting of trinitrotoluene (TNT), cyclotetramethylene-tetranitramine (HMX), cyclotrimethylenetrinitramine (RDX), pentaerythritol tetranitrate (PETN), hexanitrostilbene (HNS) and picrylamino dinitropyridine (PYX).

6. A method of fracturing a geological formation surrounding a cased well bore, comprising the steps of:

(a) emplacing at least one small explosive charge in a well bore having a casing, said explosive charge having a loading density of between approximately one and six grams per centimeter of well bore depth;

(b) filling said well bore with a suitable fluid and hydraulically pressurizing said fluid to a pressure greater than the fracture propagating pressure and less than the formation breakdown pressure of said geological formation; and (c) detonating said explosive charge while said fluid is pressurized, so as to obtain a multiplicity of fractures in said geological formation.

7. The method defined in claim 6 further comprising the step of hydraulically pressurizing said well bore after detonation of said explosive charge so as to extend and propagate fractures formed by said detonation.

8. The method defined in claim 7 wherein said explosive charge is emplaced at locations in said well bore corresponding to the depths of oil- or gas-bearing formations.

9. The method defined in claim 8 wherein said explosive charge is selected from the group consisting of trinitrotoluene (TNT), cyclotetramethylene-tetranitramine (HMX), cyclotrimethylenetrinitramine (RDX), pentaerythritol tetranitrate (PETN), hexanitrostilbene (HNS) and picrylamino dinitropyridine (PYX).

10. The method defined in claim 9 further comprising the step of hydraulically pressurizing said well bore after detaontion of said explosive charge so as to extend and propagate fractures formed by said detonation.

11. The method defined in claim 10 wherein said explosive charge is emplaced at locations in said well bore corresponding to the depth of oil or gas bearing formations.

12. A method of fracturing a geological formation surrounding a cased well bore, comprising the steps of:

(a) emplacing at least one explosive charge in said well bore, said explosive charge being of a size sufficiently small that detonation of said explosive charge will not cause formation damage in said well bore, said explosive charge having a loading density of between approximately one and six grams per centimeter of well bore length;

(b) detonating said explosive charge while said fluid is pressurized, so as to obtain a multiplicity of fractures in said formation; and (c) hydraulically pressurizing said well bore after detonation of said explosive charge so as to extend and propagate fractures formed by said detonation.

13. The method defined in claim 12 wherein said explosive charge is selected from the group consisting of trinitrotoluene (TNT), cyclotetramethylene-tetranitramine (HMX), cyclotrimethylenetrinitramine (RDX), pentaerythritol tetranitrate (PETN), hexanitrostilbene (HNS) and picrylamino dinitropyridine (PYX).

14. The method defined in claim 12 further comprising the step of emplacing a shock reflector in said well bore adjacent said explosive charge so as to selectively direct the primary direction of emission of shock waves upon detonation of said explosive charge, and so as to thereby cause multiple fracturing of said formation in the direction of emission of said shock waves from said well bore.

* * * * *